US007963639B2

(12) United States Patent
Fujii et al.

(10) Patent No.: US 7,963,639 B2
(45) Date of Patent: Jun. 21, 2011

(54) LIQUID EJECTION DEVICE

(75) Inventors: Takamichi Fujii, Kanagawa-ken (JP); Mitsuru Sawano, Tokyo (JP)

(73) Assignee: Fujifilm Corporation, Tokyo (JP)

( * ) Notice: Subject to any disclaimer, the term of this patent is extended or adjusted under 35 U.S.C. 154(b) by 154 days.

(21) Appl. No.: 12/399,642

(22) Filed: Mar. 6, 2009

(65) Prior Publication Data

US 2009/0225140 A1 Sep. 10, 2009

(30) Foreign Application Priority Data

Mar. 7, 2008 (JP) ..... 2008-057507

(51) Int. Cl.
*B41J 2/045* (2006.01)

(52) U.S. Cl. ..... 347/70

(58) Field of Classification Search ..... 347/70, 347/71–72, 68–69; 400/124.14, 124.16; 310/311, 324, 327, 333
See application file for complete search history.

(56) References Cited

U.S. PATENT DOCUMENTS 7,646,138 B2 * 1/2010 Williams ..... 310/333
2002/0080214 A1 * 6/2002 Higuchi et al. ..... 347/68
2003/0035031 A1 * 2/2003 Ito et al. ..... 347/71
2007/0134434 A1 6/2007 Yokoyama et al.
2008/0074471 A1 * 3/2008 Sakashita et al. ..... 347/68

FOREIGN PATENT DOCUMENTS

JP 03097566 * 4/1991
JP 2000-326506 A 11/2000
JP 2005-161341 A 6/2005

* cited by examiner

*Primary Examiner* — K. Feggins
(74) *Attorney, Agent, or Firm* — Birch, Stewart, Kolasch & Birch, LLP

(57) ABSTRACT

A liquid ejection device includes a liquid ejection member including a pressurized liquid chamber and a liquid ejection orifice which is in fluid communication with the pressurized liquid chamber to eject a liquid in the pressurized liquid chamber to the outside. A piezoelectric device is formed on the pressurized liquid chamber via a vibrating diaphragm. The piezoelectric device includes a lower electrode, a piezoelectric film and an upper electrode, which are disposed sequentially. The piezoelectric film is a thin-film piezoelectric material having a Curie point of 200° C. or more. The liquid ejection device further includes a heating element for heating a material, which has a melting point of not less than 150° C. and lower than the Curie point of the piezoelectric film, charged in the pressurized liquid chamber to a temperature not less than the melting point of the material.

20 Claims, 7 Drawing Sheets

LIQUID EJECTION DEVICE

BACKGROUND OF THE INVENTION

1. Field of the Invention

The present invention relates to a liquid ejection device including a piezoelectric device.

2. Description of the Related Art

A piezoelectric device, which includes a piezoelectric layer having piezoelectricity to expand or contract along with increase or decrease of the intensity of an electric field applied thereto, and upper and lower electrode layers for applying the electric field to the piezoelectric layer, is used, for example, as an actuator in an inkjet marking head. The basic structure of the inkjet marking head includes an ink nozzle, which includes a pressurized liquid chamber (an ink chamber) and an ink ejection orifice, through which ink is ejected from the pressurized liquid chamber to the outside. Further, a diaphragm and the above-described piezoelectric device are attached to the ink nozzle. Typical piezoelectric materials used in conventional inkjet marking heads (hereinafter simply referred to as "head") have a Curie point of at most about 140° C., and they are assumed to be used at the room temperature.

On the other hand, another type of actuator for use in a similar inkjet head proposed in Japanese Unexamined Patent Publication No. 2000-326506 includes a phase transition film that deflects along with phase transition of the crystal structure thereof, and a heating element for heating the phase transition film to a temperature around the Curie point, which is the phase transition temperature of the phase transition film. However, preferred piezoelectric materials disclosed in this patent document are those having a Curie point ranging from 50° C. to 90° C.

When electronic parts are mounted on a wiring board, electrode portions of the electronic parts are conventionally connected to the wiring pattern of the substrate through reflow soldering. In the reflow soldering, first, solder is fed to pads or lands of the wiring pattern on the wiring board. Then, the electronic parts are appropriately arranged on the pads or lands, and the substrate is heated in a reflow furnace to connect the electrode portions of the electronic parts to the wiring pattern. In the conventional reflow soldering, in order to feed the solder onto the substrate, cream solder is fed by screen printing through a metal mask.

The screen printing, however, is not suitable for precision printing.

Therefore, in order to carry out precision printing of the solder material, attempts have been made to use an inkjet printing technique to perform precision printing of the solder using the above-described inkjet marking head, and Japanese Unexamined Patent Publication No. 2005-161341 discloses a solder material for connecting electronic parts to a wiring board, which can be ejected using the inkjet printing technique.

Further, U.S. Patent Application Publication No. 20070134434 discloses a solder patterning method using an inkjet printing technique, which involves ejecting two or more types of metal pastes independently from each other onto a substrate, so that the solder composition of a formed solder pattern is adjusted by the ejected amount of each metal paste.

Since the conventional heads are assumed to mainly be driven at the room temperature, as described above, the methods proposed in the above Japanese Unexamined Patent Publication No. 2005-161341 and U.S. Patent Application Publication No. 20070134434 use a solder material or metal in the form of paste which can be ejected at the room temperature. These solder patterning methods using the inkjet printing technique necessitate heat treatment (reflow treatment) of the solder paste or the metal paste, which has been ejected and patterned on a substrate, to connect the electronic parts to the substrate.

During the heat treatment, the substrate having the electronic parts arranged thereon is heated to a temperature equal to or higher than the melting point of the solder, and this may damage the electronic parts.

Therefore, a means to achieve solder patterning which does not necessitate the heat treatment to connect electronic parts onto a substrate is desired.

SUMMARY OF THE INVENTION

In view of the above-described circumstances, the present invention is directed to providing a liquid ejection device which can be driven at a high temperature.

The liquid ejection device of the invention includes: a liquid ejection member including a pressurized liquid chamber and a liquid ejection orifice, the liquid ejection orifice being in fluid communication with the pressurized liquid chamber to eject a liquid in the pressurized liquid chamber to the outside; a vibrating diaphragm; a piezoelectric device formed on the pressurized liquid chamber via the vibrating diaphragm, the piezoelectric device including a lower electrode, a piezoelectric film and an upper electrode disposed sequentially, the piezoelectric film being a thin-film piezoelectric material having a Curie point of 200° C. or more; and a heating means for heating a material charged in the pressurized liquid chamber, the material having a melting point of not less than 150° C. and lower than the Curie point of the piezoelectric film, the heating means heating the material to a temperature not less than the melting point of the material.

The Curie point of the thin-film piezoelectric material may be higher than the melting point of the material charged in the pressurized liquid chamber by 50° C. or more. The Curie point of the piezoelectric film may be 250° C. or more, may optionally be 300° C. or more, or may further optionally be 350° C. or more.

Examples of the material may include low melting point metals, such as In, Pb, Bi and Sn, and solder materials.

An amount of displacement of the piezoelectric film at an operating temperature, when a predetermined driving voltage is applied to the piezoelectric film, may be at least 50% of an amount of displacement of the piezoelectric film at the room temperature.

A piezoelectric constant of the piezoelectric film at the room temperature may be at least 200 pm/V. It should be noted that the type of piezoelectric constant used herein is $d_{31}$, which represents expansion and contraction in a direction along the electrode surface, and all the piezoelectric constant values herein are presented in absolute values.

The room temperature herein is 25° C.

The piezoelectric film may be composed of a perovskite oxide (which may contain incidental impurities). In this case, the piezoelectric film may have a columnar crystalline film structure including a number of columnar crystals. Further, the piezoelectric film may have (100) crystal orientation.

In the case where the piezoelectric film is composed of the perovskite oxide, the composition of the piezoelectric film may include lead zirconate titanate (PZT) and at least one selected from the group consisting of Nb, W, Ni and Bi added thereto.

The pressurized liquid chamber may be formed in a Si substrate.

The heating means may be disposed outside the liquid ejection member and may heat the material via the liquid ejection member. In this case, the heating means may be a thin-film heating element.

The piezoelectric film may polarize in a direction from the lower electrode side to the upper electrode side, a positive side of the spontaneous polarization of the piezoelectric film may face the lower electrode layer, and a negative side of the spontaneous polarization of the piezoelectric film may face the upper electrode layer. The upper electrode layer may be a ground electrode where an applied voltage is fixed, and the lower electrode layer may be an address electrode where an applied voltage is varied.

DESCRIPTION OF THE PREFERRED EMBODIMENTS

Hereinafter, embodiments of the present invention will be described with reference to the drawings.

Inkjet Head

Figure 1:
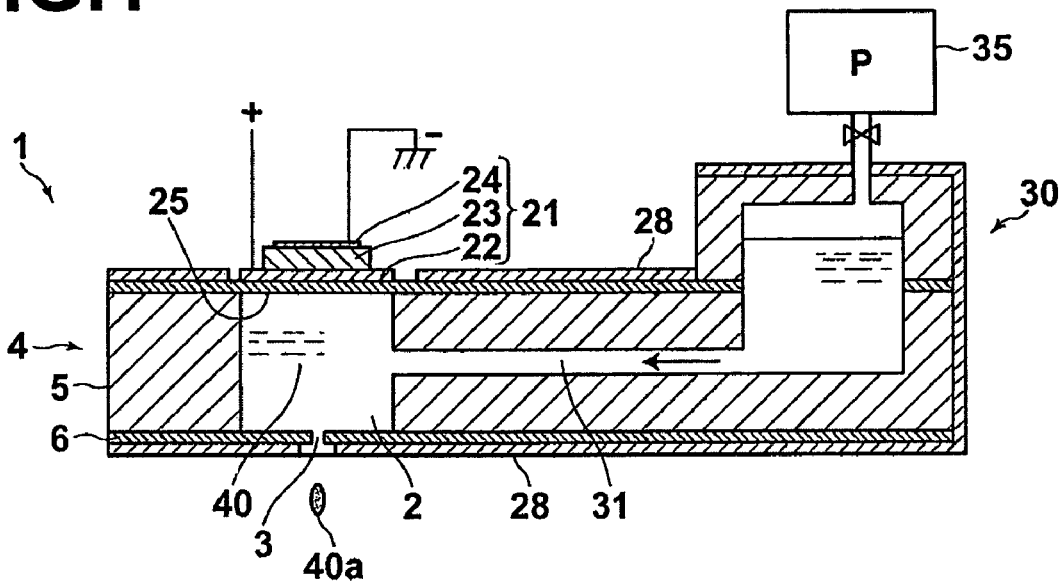
FIG. 1 is a sectional view illustrating the structure of an inkjet head (liquid ejection device) according to one embodiment of the invention.

Now, the structure of an inkjet head (liquid ejection device) according to one embodiment of the invention is described with reference to FIG. 1. FIG. 1 is a sectional view of the main portion of the inkjet head. It should be noted that the components shown in the drawing are not to scale for ease of visual recognition.

The inkjet head (liquid ejection device) 1 of this embodiment includes: a nozzle (liquid ejection member) 4, which includes a pressurized liquid chamber 2 and a liquid ejection orifice (liquid ejection orifice) 3, through which a liquid 40*a* in the pressurized liquid chamber 2 is ejected to the outside; a piezoelectric device 21 provided correspondingly to the pressurized liquid chamber 2 of the nozzle 4; a vibrating diaphragm (diaphragm) 25 forming the upper wall surface of the pressurized liquid chamber 2 and serving to transmit expansion and contraction of the piezoelectric device 21 to the pressurized liquid chamber 2; and a thin-film heating element (heating means) 28 disposed outside the nozzle 4.

The inkjet head 1 of this embodiment further includes a reservoir 30 to pool a material 40 to be fed to the pressurized liquid chamber 2, a flow path 31 to feed the material 40 from the reservoir 30 to the pressurized liquid chamber 2, and a pump 35 to apply a pressure, which is not large enough to cause ejection of the liquid 40*a* through the ejection orifice 3, to the pressurized liquid chamber 2 when the head is not driven.

In this embodiment, the nozzle 4 is formed by forming the pressurized liquid chamber 2 and the flow path 31 in fluid communication with the pressurized liquid chamber 2 in a substrate 5 through dry etching or wet etching, and bonding a thin plate 6, which includes the liquid ejection orifice 3, to the substrate 5. The diaphragm 25 is formed by machining the substrate 5 to form one of the walls of the pressurized liquid chamber 2. The piezoelectric device 21 is formed on the diaphragm 25. Further, a portion of the reservoir 30 is simultaneously formed in the substrate 5. The reservoir 30 is formed by bonding another substrate, which includes a recess forming the upper portion of the reservoir 30, to the substrate 5, such that the recess of the other substrate is aligned with the recess of the substrate 5 forming the lower portion of the reservoir 30.

The thin-film heating element 28 extends over the upper and lower surfaces of the head 4 and the outer walls of the reservoir 30. The thin-film heating element 28 can be formed, for example, by a thin-film heater made of NiCr. The heating means used in the invention is not limited to the thin-film heating element 28. The heating means may have any form as long as it can heat and melt the material 40 in the pressurized liquid chamber. For example, the heating means may be achieved by providing a heater covering the entire head, placing the entire head in a heating atmosphere, or providing an infrared heating lamp to heat the entire head.

The substrate 5 may be a silicon substrate in view of thermal conductivity and machinability. In particular, a laminated substrate, such as a SOI substrate formed by a $SiO_2$ film and a Si active layer sequentially formed on a silicon substrate, may be used as the substrate 5. Further, a buffer layer to ensure good lattice matching and/or an adhering layer to ensure good adhesion between the electrode and the substrate may be provided between the diaphragm 25 and a lower electrode layer 22.

The substrate 5, in which the pressurized liquid chamber is formed, and the diaphragm 25 may be formed as a single part or separate parts. If they are formed as separate parts, the material of the substrate is not limited to silicon, and other materials, such as glass, stainless steel (SUS), yttrium-stabilized zirconia (YSZ), alumina, sapphire and silicon carbide may be used.

The piezoelectric device 21 includes the lower electrode layer 22, a piezoelectric film 23 and an upper electrode layer 24, which are sequentially formed on the diaphragm 25. The lower electrode layer 22 and the upper electrode layer 24 apply an electric field in the film thickness direction to the piezoelectric film 23.

In the inkjet head 1, the intensity of the electric field applied to the piezoelectric device 21 is increased or decreased to make the piezoelectric device 21 expand or contract, thereby controlling ejection of the liquid 40*a* and the amount of the liquid 40*a* ejected from the pressurized liquid chamber 2.

In this embodiment, the negative side of the spontaneous polarization of the piezoelectric film 23 faces the lower electrode layer 22 and the positive side of the spontaneous polarization of the piezoelectric film 23 faces the upper electrode layer 24 (that is, the direction of the spontaneous polarization is upward). The upper electrode layer 24 serves as a ground (GND) electrode where the applied voltage is fixed, and the lower electrode layer 22 serves as an address electrode where the applied voltage is varied. The piezoelectric device 21 also includes a driving driver (not shown), which exerts drive control to vary the voltage applied to the lower electrode layer 22.

The main component of the lower electrode layer 22 is not particularly limited, and examples thereof include metals or metal oxides, such as Ir, Au, Pt, $IrO_2$, $RuO_2$, $LaNiO_3$ and $SrRuO_3$, and combinations thereof. The thicknesses of the lower electrode layer 22 and the upper electrode layer 24 are not particularly limited, and may be in the range from 50 to 500 nm.

The main component of the upper electrode layer 24 is not particularly limited, and examples thereof include the materials listed above for the lower electrode layer 22, electrode materials typically used in semiconductor processes, such as Al, Ta, Cr and Cu, and combinations thereof.

The film thickness of the piezoelectric film 23 is not particularly limited, and may usually be 1 μm or more, such as 1 to 10 μm.

The material of the piezoelectric film 23 is not particularly limited, as long as it has a Curie point of 200° C. or more (or optionally 300° C. or more). The amount of displacement of the piezoelectric film 23 at the operating temperature when a predetermined driving voltage is applied thereto may be at least 50% of the amount of displacement of the piezoelectric film at the room temperature. Further, the piezoelectric constant at the room temperature may be at least 200 pm/V.

In conventional inkjet heads, the piezoelectric material of the piezoelectric device has a Curie point of at most around 140° C., which is far lower than that of the piezoelectric film of the device of the invention. For example, the above-mentioned U.S. Patent Application Publication No. 20070134434 lists, as preferred examples, piezoelectric materials having a Curie point ranging from 50° C. to 90° C. Therefore, if a conventional head is heated to a high temperature of 200° C. or more to eject the solder material in the liquid phase, the temperature exceeds the Curie point of the piezoelectric material of the head, and thus it is impossible to drive the piezoelectric device. Further, the piezoelectric materials used in conventional heads are depolarized when the temperature is increased, even when the temperature does not exceed the Curie point of the piezoelectric materials, and thus it is impossible to drive the piezoelectric device. Therefore, as described in the above-mentioned Japanese Unexamined Patent Publication Nos. 2000-326506 and 2005-161341, conventionally, the head is not heated to a high temperature of 150° C. or more (the head is usually operated at the room temperature), and the inkjet head is used to eject a solder paste or a metal paste onto a printed wiring board. Then, the printed wiring board having electronic parts arranged thereon is subjected to heat treatment in a reflow furnace.

Since typical solder materials have a melting point of around 180° C. to 250° C., providing the piezoelectric film having a Curie point higher than the melting point of a desired solder material, as in the liquid ejection device of the invention, allows ejection of the solder material in the melted state through the liquid ejection orifice. Thus, when electronic parts are mounted onto a wiring board, soldering of the electronic parts can be achieved without performing the conventionally-required heat treatment. Thus, according to the liquid ejection device of the invention, adverse effect of the heat treatment on the printed wiring board can be eliminated and the number of production processes can be reduced. Further, even if some of a number of electronic parts connected to a printed wiring board have come off, the parts can be connected again to the printed wiring board by soldering using the liquid ejection device of the invention, and this is convenient and useful.

Further, the piezoelectric film 23 sufficiently works as the piezoelectric device at the operating temperature if the amount of displacement of the piezoelectric film 23 at the operating temperature when the predetermined driving voltage is applied thereto is at least 50% of the amount of displacement at the room temperature. In particular, if the piezoelectric constant of the piezoelectric film 23 at the room temperature is at least 200 pm/V, the piezoelectric film 23 is sufficiently effective as the piezoelectric device even when the amount of displacement of the piezoelectric film 23 at the operating temperature is reduced to around 50% of that at the room temperature.

Depending on the melting point of the material to be ejected from the liquid ejection device 1, the piezoelectric device 21 may be provided with a piezoelectric film that can provide a sufficient amount of displacement at the melting point. The material to be ejected by the inkjet head of this embodiment may be any material that has a melting point of 150° C. or more and lower than the Curie point of the piezoelectric film 23, and examples thereof include low melting point metals, such as In, Pb, Bi and Sn and solder materials, such as Sn (232° C.), Sn-0.7Cu (227° C.), Sn-3.5Ag (221° C.), Sn-3.0Ag-0.5Cu (217-220° C.), Sn-9.0Zn (199° C.), Sn-8.0Zn-3.0Bi (187-197° C.), Sn—Pb (183° C.) and Sn-57Bi (139° C.) (the temperatures shown in the brackets are melting points).

For example, in order to eject a Sn-57Bi solder material having a melting point of 139° C., the head may be heated to around 170° C., and the piezoelectric film may have a Curie point of about 220° C. or more. In order to eject a tin-silver solder material having a melting point of 220° C., the head may be heated to around 270° C., and the piezoelectric film may have a Curie point of 320° C. or more. It should be noted that the Curie point of the piezoelectric film may be higher than the melting point of the material to be ejected by 50° C. or more. The temperature to which the head is heated may be higher than the melting point of the material to be ejected by 50° C. or more. The Curie point of the piezoelectric film may be higher than the temperature to which the head is heated by 50° C. or more. However, the above temperature differences among the melting point of the material to be ejected, the temperature to which the head is heated and the Curie point of the piezoelectric film are not always necessary, and these temperatures may appropriately be set to satisfy the following relationship: the melting point of the material to be ejected≦ the temperature to which the head is heated< the Curie point of the piezoelectric film.

A specific example of the material to form the piezoelectric film 23 is a perovskite oxide (which may contain incidental impurities). In particular, a PZT or a B-site substituted PZT represented by general formula (P-1) or (P-2) below, or a mixed crystal system thereof are applicable as the piezoelectric film 23.

$$Pb_a(Zr_{b1}Ti_{b2}X_{b3})O_3 \quad \text{(P-1)}$$

(wherein X represents at least one metal element selected from the group consisting of Nb, W, Ni and Bi, where a>0, b1>0, b2>0 and b3≧0. Typically, a=1.0 and b1+b2+b3=1.0. However, these values may not exactly be 1.0 as long as the perovskite structure is formed), or $$(Pb_aX_{a1})(Zr_{b1}Ti_{b2})O_3 \quad \text{(P-2)}$$

(wherein X represents at least one metal element selected from the group consisting of La, Bi and W, where a>0, a1≧0, b1>0 and b2>0. Typically, a+a1=1.0 and b1+b2=1.0. However, these values may not exactly be 1.0 as long as the perovskite structure is formed.)

To drive the inkjet head 1, first, the thin-film heating element 28 heats the head 4 and the reservoir 30 to heat the material (the solder material in this embodiment) 40 to a temperature not less than the melting point of the solder material 40 and melt the solder material 40. The pump 35 applies a pressure, which is not large enough to cause ejection of the melted solder material 40 through the ejection orifice 3 (large enough to balance with the surface tension of the solder material) from the reservoir 30 side. In this state, the piezoelectric device 21 is driven to eject the solder material 40*a* onto a desired position of a printed wiring board, for example. It should be noted that, if the temperature at the position where the ejected solder material is deposited is much lower than the melting point of the solder material, the solder material may immediately be solidified. In order to avoid this situation, the position where the ejected solder material is deposited may be preheated to some extent (for example, to around 100° C.).

The printed wiring board, or the like, may be heated using any method, such as placing a heater at the back side of the printed wiring board to directly heat the printed wiring board via the back side thereof, applying hot wind of about 150° C. to the front side of the printed wiring board until just before the ejection of the liquid, or heating the front side of the printed wiring board by an infrared lamp.

It should be noted that the material to be ejected using the liquid ejection device (inkjet head) of the invention is not limited to low melting point metals and solder materials. Other materials, such as an ultraviolet curing ink, a conductive paste, a sol-gel solution and a wax for semiconductor, which are desired to be ejected at a high temperature may also be ejected using the liquid ejection device of the invention. Further, the liquid ejection device of the invention is also effective to eject a material that is highly viscous around the room temperature and is difficult to be ejected like ink at the room temperature (such as solder, an ultraviolet curing ink, a conductive paste, a sol-gel solution, a wax for semiconductor or any other thermoplastic polymer). The liquid ejection device of the invention ejects such a material with raising the temperature of the material (to 150° C., for example) so that the viscosity of the material largely decreases.

Now, one example of a method for producing the piezoelectric device 21 forming the above-described head is described.

First, the pressurized liquid chamber 2, the flow path, and the like, are formed in the substrate 5 through etching, and the surface which forms one of the walls of the pressurized liquid chamber 2 of the substrate is machined into the diaphragm 25. Then, the substrate 5 is bonded with the thin plate 6 which includes the ejection orifice. Thereafter, the lower electrode layer 22 is formed correspondingly to the pressurized liquid chamber 2 of the substrate 5. Prior to forming the lower electrode layer 22, a buffer layer and/or an adhering layer may be formed, as necessary. Then, the piezoelectric film 23 is formed on the lower electrode layer 22, and the upper electrode layer 24 is formed on piezoelectric film 23. Finally, the drive driver and necessary wiring are formed to complete the piezoelectric device 21.

The piezoelectric film 23, the lower electrode layer 22 and the upper electrode layer 24 may be formed by any method, and examples of the method include sputtering, ion beam sputtering, ion plating, or vapor deposition using plasma, such as plasma CVD.

When the direction of the applied electric field matches the vector component of the spontaneous polarization axis of the piezoelectric film 23, the piezoelectric film 23 effectively expands or contracts along with increase or decrease of the intensity of the applied electric field, thereby effectively providing the piezoelectric effect by the electric field-induced deflection. Therefore, the piezoelectric film 23 may be formed by an oriented crystalline film with small variation in the direction of the spontaneous polarization axis.

The crystal structure of the piezoelectric film 23 is not particularly limited. If the piezoelectric film 23 is formed by a PZT perovskite oxide, the PZT perovskite oxide may have a crystal structure of tetragonal system, rhombohedral system, or mixed crystal system thereof. For example, $Pb_{1.3}Zr_{0.52}Ti_{0.48}O_3$ with the MPB composition may have a tetragonal single crystal structure, a mixed crystal structure including tetragonal and rhombohedral phases, or a rhombohedral single crystal structure, depending on film formation conditions.

In this embodiment, the negative side of the spontaneous polarization of the piezoelectric film 23 faces the lower electrode layer 22, and the positive side of the spontaneous polarization of the piezoelectric film 23 faces the upper electrode layer 24 (that is, the direction of the spontaneous polarization is upward).

The piezoelectric film 23 may have a columnar crystal film structure formed by a number of columnar crystals that extend non-parallel to the surface of the substrate. Such a film is an oriented film with uniform crystal orientation, and provides high piezoelectric performance.

The piezoelectric deflection may include:

(1) normal electric field-induced piezoelectric deflection, which is induced by expansion and contraction of the piezoelectric material in the direction of the applied electric field along with increase and decrease of the intensity of the applied electric field, when the direction of the applied electric field matches the vector component of the spontaneous polarization axis;

(2) piezoelectric deflection induced by reversible non-180° rotation of the polarization axis of the piezoelectric material along with increase and decrease of the intensity of the applied electric field;

(3) piezoelectric deflection utilizing volume change due to phase transition of the crystals of the piezoelectric material along with increase and decrease of the intensity of the applied electric field; and (4) piezoelectric deflection utilizing the engineered domain effect to provide larger deflection, which is achieved by forming an oriented crystalline structure including a ferroelectric phase with a crystal orientation that is different from the direction of the spontaneous polarization axis by using a material that experiences phase transition due to the applied electric field (when the engineered domain effect is utilized, the piezoelectric film may be driven under conditions which induce the phase transition, or may be driven in a range where no phase transition is induced).

A desired amount of piezoelectric deflection can be provided by using any of the above-described piezoelectric deflection mechanisms (1)-(4) singly or in combination. Further, by providing an oriented crystalline structure appropriate for the principle of each deflection mechanism, larger piezoelectric deflection can be provided using any of the above-described piezoelectric deflection mechanisms (1)-(4). Therefore, in order to provide high piezoelectric performance, an orientated piezoelectric film may be used.

The non-parallel growth direction of the columnar crystals may include a substantially perpendicular direction or an oblique direction with respect to the surface of the substrate.

The average column diameter of the columnar crystals forming the piezoelectric film is not particularly limited, however, may be in the range from 30 nm to 1 μm. If the average column diameter of the columnar crystal is excessively small, the crystal growth of the piezoelectric film may not be sufficient and the piezoelectric film may not be able to provide desired piezoelectric performance. If the average column diameter of the columnar crystals is excessively large, accuracy of the form after patterning may be lowered.

If the piezoelectric film 23 is formed, for example, by a system including a rhombohedral phase (a mixed crystal system including tetragonal and rhombohedral phases, or a rhombohedral system), the piezoelectric film 23 may have the (100) crystal orientation. Since the direction of the spontaneous polarization axis of the rhombohedral crystal is <111>, the spontaneous polarization of the piezoelectric film with the (100) orientation has an upward vector component.

Method for Producing Piezoelectric Film

Now, specific embodiments of a method for producing the piezoelectric films are described. The production method of this embodiment can provide a (100) orientation film formed by a PZT perovskite oxide having a columnar crystal structure, which may particularly be usable as the piezoelectric film 23 of the piezoelectric device 21 in that the Curie point of the piezoelectric film is 200° C. or more, the amount of displacement of the piezoelectric film at the operating temperature when the predetermined driving voltage is applied thereto is at least 50% of the amount of displacement of the piezoelectric film at the room temperature, and the piezoelectric constant at the room temperature is at least 200 pm/V. Further, applying the film formation method described below, the piezoelectric film composed of the perovskite oxide spontaneously polarizes when no voltage is applied thereto.

The piezoelectric film containing the perovskite oxide represented by general formula (P-1) or (P-2) can be formed using a nonthermal equilibrium process. Examples of the film formation method for the piezoelectric film may include sputtering, plasma CVD, burning and rapid quenching, annealing and quenching, and thermal spraying and rapid quenching. Among them, sputtering may particularly be usable.

In a thermal equilibrium process, such as the sol-gel method, it is essentially difficult to densely dope an additive that has an unmatched valence, and it is necessary to add something, such as a sintering aid or an acceptor ion. In contrast, the nonthermal equilibrium process allows dense doping of a donor ion without such addition.

Further, in the nonthermal equilibrium process, the film can be formed at a relatively low film formation temperature that is not higher than the temperature at which Si reacts with Pb, and therefore, the film can be formed on a Si substrate that has good machinability.

Factors that influence properties of the film formed by sputtering may include the film formation temperature, the type of the substrate, the composition of an underlying film (if any) formed on the substrate before the piezoelectric film is formed, the surface energy of the substrate, the film formation pressure, the amount of oxygen in the atmosphere gas, the applied electric power, the distance between the substrate and the target, the temperature and density of electrons in the plasma, and the density and life of active species in the plasma.

Among a number of film formation factors, the present inventors have examined factors that largely influence the properties of the formed film, and found film formation conditions that allow formation of a quality film (see Japanese Patent Application Nos. 2006-263978, 2006-263979 and 2006-263980 filed by the present applicant).

Figure 6:
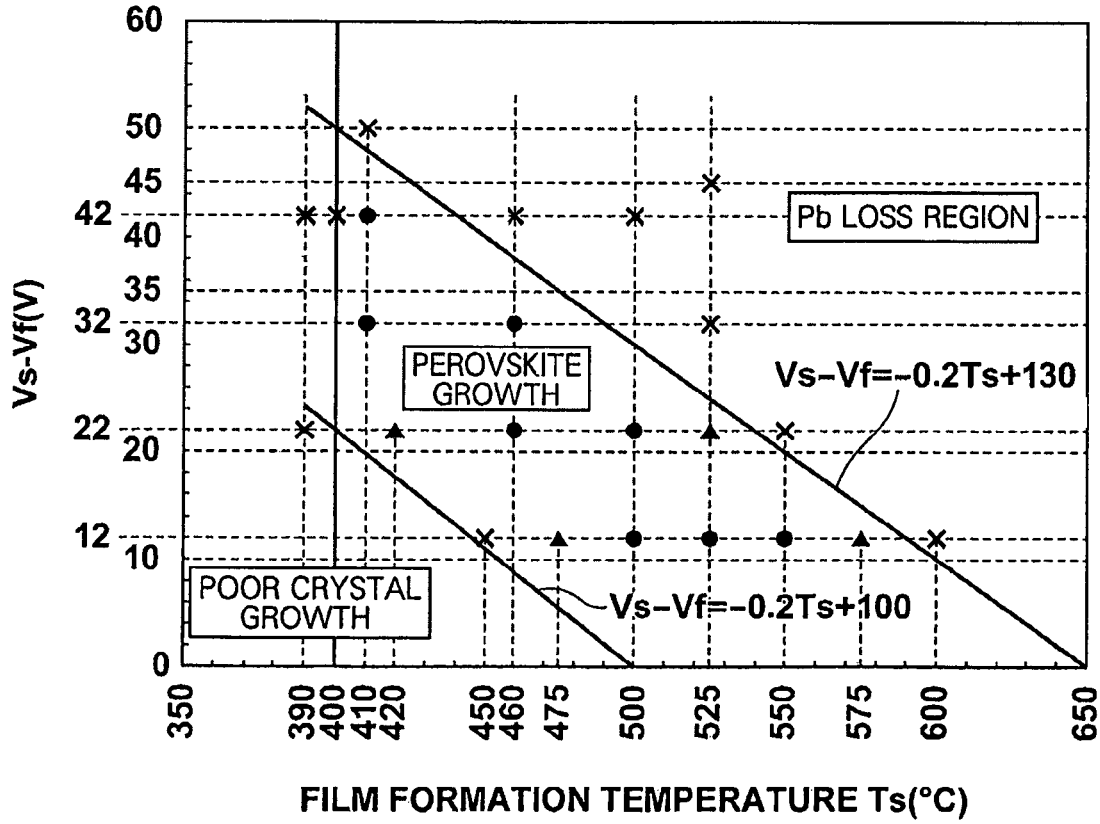
FIG. 6 is a graph showing the relationship among properties of PZT piezoelectric films formed in a nonequilibrium process and a film formation temperature Ts and a potential difference Vs−Vf during the process.
Figure 7:
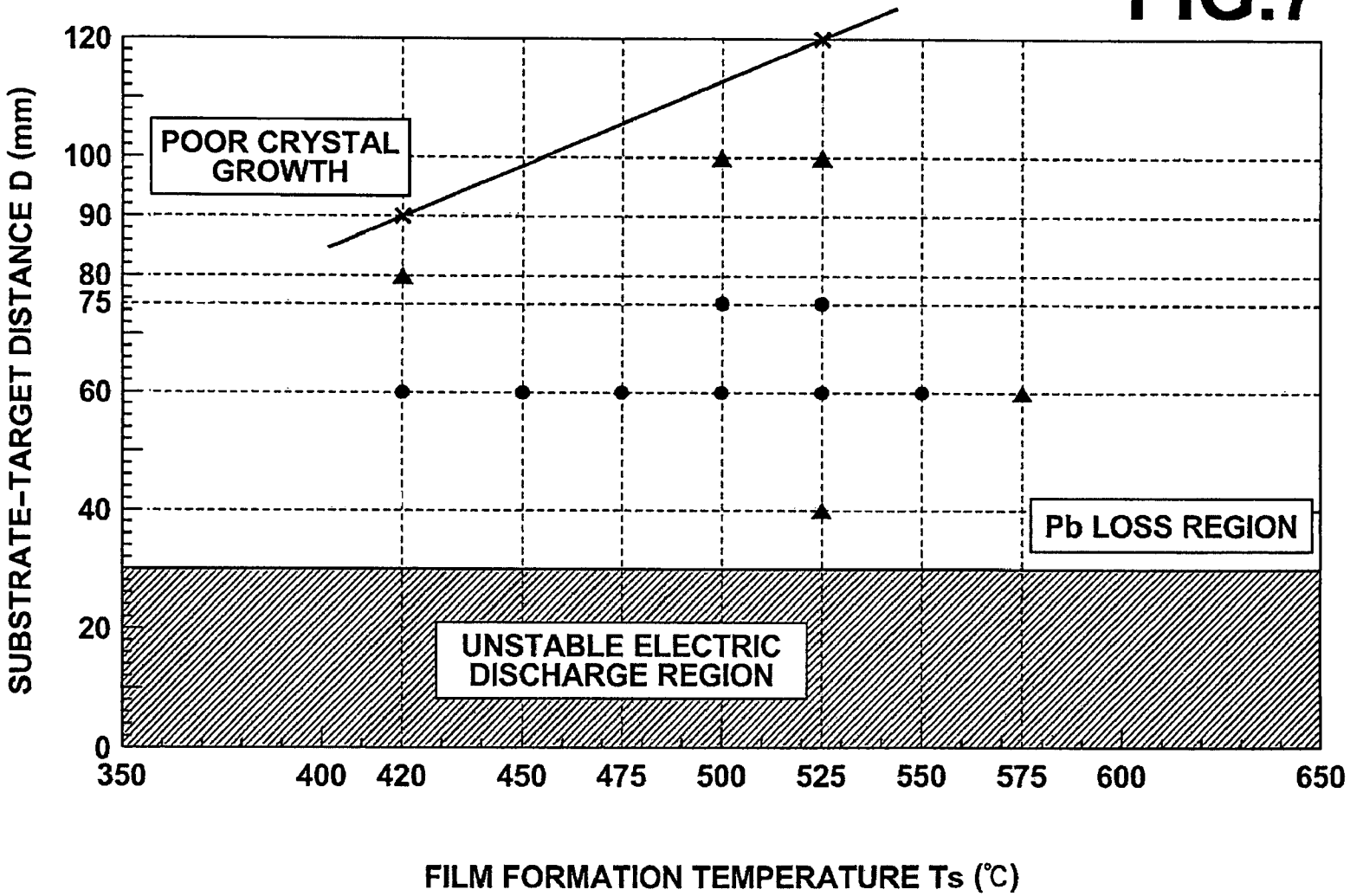
FIG. 7 is a graph showing the relationship among properties of PZT piezoelectric films formed in a nonequilibrium process and the film formation temperature Ts and a substrate-target distance D during the process.
Figure 8:
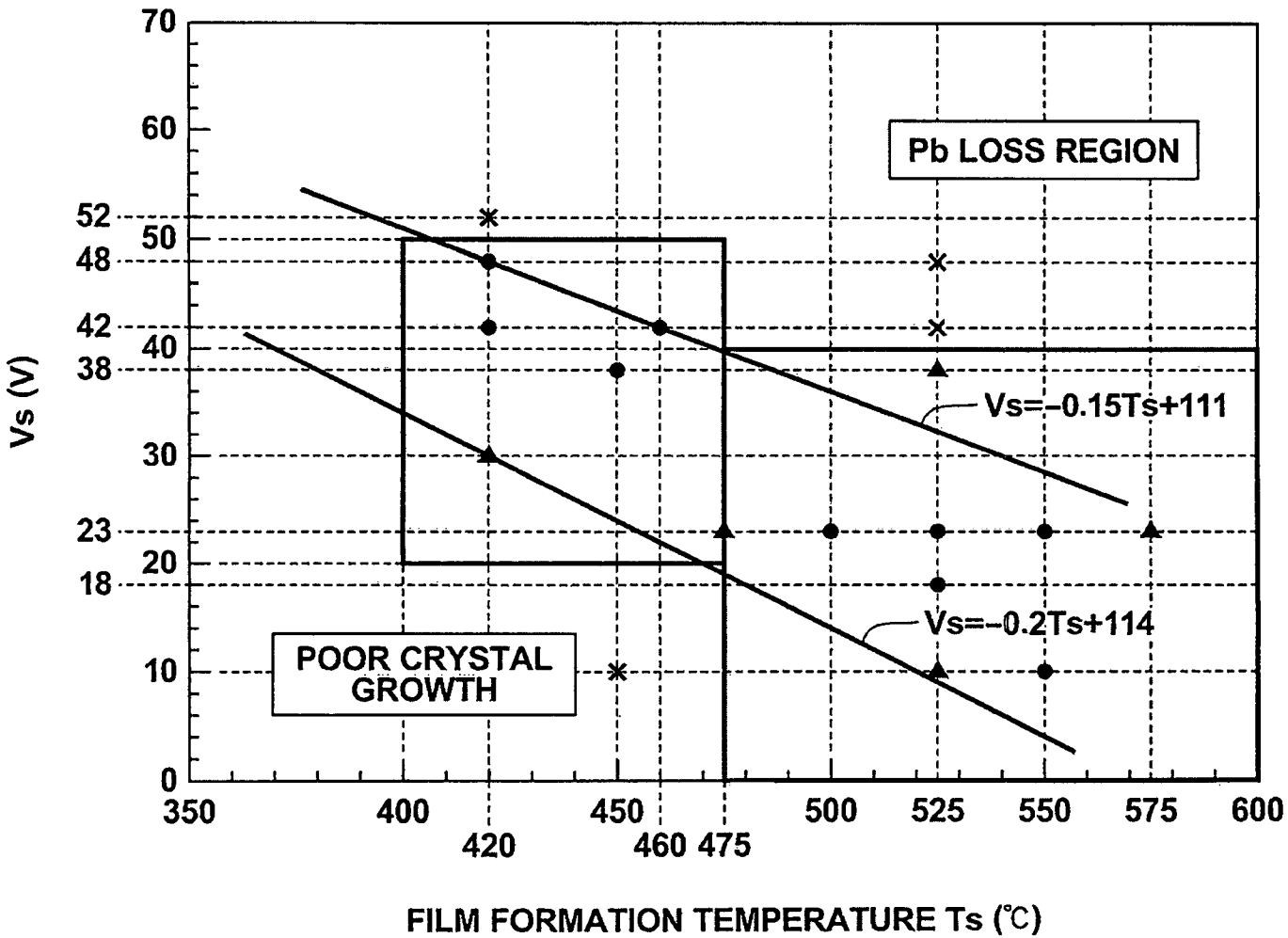
FIG. 8 is a graph showing the relationship among properties of PZT piezoelectric films formed in a nonequilibrium process and the film formation temperature Ts and a plasma potential Vs during the process.

Specifically, it has been found that a quality film can be formed by optimizing a film formation temperature Ts and any of a potential difference Vs−Vf (Vs is a plasma potential in the plasma during film formation and Vf is a floating potential), the plasma potential Vs, and a distance D between the substrate and the target (hereinafter referred to as "substrate-target distance D"). Namely, by plotting the properties of the formed films with the film formation temperature Ts plotted along the abscissa axis and any of the potential difference Vs−Vf, the plasma potential Vs and the substrate-target distance D plotted along the ordinate axis, it has been found that a quality film can be formed within a certain range (see FIGS. 6-8). In FIGS. 6-8, films mainly composed of a pyrochlore phase are indicated by the "cross" mark, which means "poor", films having variation in film properties among the samples formed under the same conditions or unstable crystal orientation are indicated by the "triangle" mark, which means "relatively poor", and films composed of stable perovskite crystal having good crystal orientation are indicated by the "circle" mark, which means "good".

First Embodiment of Method for Producing Piezoelectric Film

The method for producing the piezoelectric film of this embodiment uses a film formation method in which the film formation temperature Ts and the potential difference Vs−Vf are optimized (see Japanese Patent Application No. 2006-263978).

In the production method of this embodiment, film formation is carried out under film formation conditions in which the film formation temperature Ts (° C.) and the potential difference Vs−Vf (V), which is a difference between the plasma potential Vs (V) in the plasma and the floating potential Vf (V) during film formation, satisfy formulae (1) and (2) below. Optionally, the film formation conditions may satisfy formulae (1)-(3) below.

$$Ts(^\circ\,\mathrm{C.}) \geqq 400 \quad (1),$$

$$-0.2Ts+100 < Vs-Vf(V) < -0.2Ts+130 \quad (2),$$

$$10 \leqq Vs-Vf(V) \leqq 35 \quad (3).$$

The "plasma potential Vs" and the "floating potential Vf" herein are measured by the single probe method using a Langmuir probe. Measurement of the floating potential Vf is conducted in a short time as possible, with placing the tip of the probe in the vicinity of the substrate (at about 10 mm from the substrate) to avoid such a situation that the film being formed, or the like, adheres to the probe and introduces error.

The potential difference Vs−Vf (V) between the plasma potential Vs and the floating potential Vf can be converted into an electron temperature (eV). The electron temperature of 1 eV is equivalent to 11600 K (K means absolute temperature).

FIG. 6 shows a result of evaluation using XRD measurement conducted by the present inventors on piezoelectric films which were formed by sputtering using a PZT ($Pb_{1.3}Zr_{0.52}Ti_{0.48}O_3$) or Nb-PZT ($Pb_{1.3}Zr_{0.43}Ti_{0.44}Nb_{0.13}O_3$) target, with varying the film formation temperature Ts and the potential difference Vs−Vf. In FIG. 6, the plots at the film formation temperature Ts of 525° C. are results for the Nb-PZT films, and other plots are results for the PZT films.

For example, under the conditions where the potential difference Vs−Vf (V) is about 12, film samples obtained at the film formation temperature Ts of 450° C. were mainly composed of the pyrochlore phase, and therefore the result of evaluation for these samples is indicated by the "cross" mark. At the film formation temperature Ts of 475° C., the pyrochlore phase was observed in film samples other than samples mainly composed of the pyrochlore phase, which were prepared under the same conditions, and therefore the result of evaluation for these samples is indicated by the "triangle" mark. Film samples obtained in the range of the film formation temperature Ts of 575° C. and higher started to show unstable crystal orientation at the film formation temperature Ts of 575° C., and therefore the result of the evaluation for the samples obtained at the film formation temperature Ts of 575° C. is indicated by the "triangle" mark, and the result of the evaluation for the samples obtained at the film formation temperature Ts of 600° C. is indicated by the "cross" mark. In the range of the film formation temperature Ts from 500 to 550° C., film samples composed of the perovskite crystal having good crystal orientation were stably obtained, and therefore the results of the evaluation for the samples obtained in this range are indicated by the "circle" mark.

FIG. 6 shows that, in the PZT films or the Nb-PZT films formed under the conditions where the film formation temperature is 400 to 600° C. and the potential difference Vs−Vf (V) is 10 to 35 eV, the perovskite crystal with low pyrochlore phase can stably be grown and Pb loss can stably be minimized, thereby allowing stable formation of a quality piezoelectric film with good crystal structure and film composition.

Figure 4:
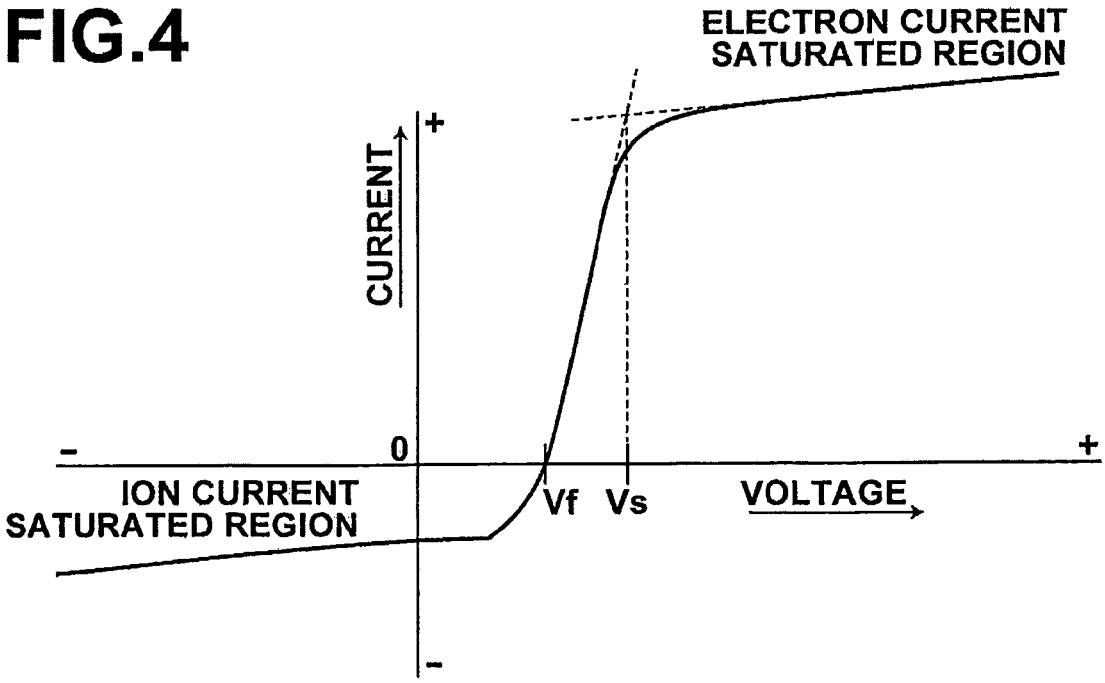
FIG. 4 is a graph for explaining how a plasma potential Vs and a floating potential Vf are measured.

The plasma potential Vs and the floating potential Vf can be measured using a Langmuir probe. When the tip of the Langmuir probe is placed in plasma P and the voltage applied to the probe is varied, current-voltage characteristics as shown in FIG. 4, for example, is obtained (Mitsuharu Konuma, "Fundamentals of Plasma and Film Formation", p. 90, published by Nikkan Kogyo Shimbun, Ltd.) In this graph, the probe potential corresponding to the current of 0 is the floating potential Vf. At this point, the amount of ion current and the amount of electron current flowing to the surface of the probe are equal to each other. The surface of a metal and the surface of a substrate in the insulated state have this potential. As the probe voltage is gradually increased from the floating potential Vf, the ion current gradually decreases, and only the electron current reaches the probe. The voltage at this boundary is the plasma potential Vs.

As will be described later, the potential difference Vs−Vf correlates with the kinetic energy of a constituent element Tp of the target T which hits the substrate B. As shown in the equation below, in general, the kinetic energy E is represented by a function of a temperature T, and therefore the potential difference Vs−Vf is considered to have the same effect on the substrate B as that of the temperature.

$$E=1/2mv^2=3/2kT$$

(wherein, m represents a mass, v represents a velocity, k represents a Boltzmann constant, and T represents an absolute temperature.)

Besides the same effect as the temperature, the potential difference Vs−Vf is believed to have an effect of promoting the surface migration, an effect of etching weakly bound portions, and the like.

The present inventors have found that, in the PZT piezoelectric film formed under the film formation conditions where Ts (° C.)<400, which do not satisfy formula (1), the perovskite crystal does not grow satisfactory because of the low film formation temperature, and the obtained film is mainly composed of the pyrochlore phase (see FIG. 6).

The present inventors have further found that, when the PZT piezoelectric film is formed under the condition where Ts (° C.)≧400, which satisfies formula (1), the film formation conditions determined within the range where the film formation temperature Ts and the potential difference Vs−Vf satisfy formula (2) allow stable growth of the perovskite crystal with low pyrochlore phase and stable minimization of Pb loss, thereby allowing stable formation of a quality piezoelectric film with good crystal structure and film composition (see FIG. 6).

It is known that, if the PZT piezoelectric film is formed by sputtering at a high temperature, tendency of the Pb loss increases. The present inventors have found that the Pb loss depends not only on the film formation temperature but also on the potential difference Vs−Vf. Among the constituent elements Pb, Zr and Ti of PZT, Pb has the highest sputter rate, i.e., is most easily sputtered. For example, Table 8.1.7 shown in "Vacuum Handbook" (edited by ULVAK, Ink., published by Ohmsha, Ltd.) shows that the sputter rates under the Ar ion condition of 300 ev is: Pb=0.75, Zr=0.48 and Ti=0.65. The fact that Pb is easily sputtered means that, even if the sputtered Pb atoms deposits on the surface of the substrate, the Pb atoms tend to be easily sputtered again. It is believed that, a larger difference between the plasma potential and the potential at the substrate, i.e., the potential difference Vs−Vf, results in higher tendency of re-sputtering, and thus the tendency of the Pb loss is increased.

Under the conditions where the film formation temperature Ts and the potential difference Vs−Vf are excessively low, the perovskite crystal is not likely to grow satisfactory. On the other hand, under the conditions where at least one of the film formation temperature Ts and the potential difference Vs−Vf is excessively high, the tendency of the Pb loss increases.

That is, under the condition where Ts (° C.)≧400, which satisfies formula (1), if the film formation temperature Ts is relatively low, it is necessary to set a relatively high potential difference Vs−Vf to satisfactory grow the perovskite crystal. On the other hand, if the film formation temperature Ts is relatively high, it is necessary to set a relatively low potential difference Vs−Vf to minimize the Pb loss. This is expressed by formula (2) above.

The present inventors have further found that, when the PZT piezoelectric film is formed, the film formation conditions determined to satisfy formulae (1)-(3) above allow formation of the piezoelectric film having a high piezoelectric constant.

Film Formation Apparatus

Figure 2A:
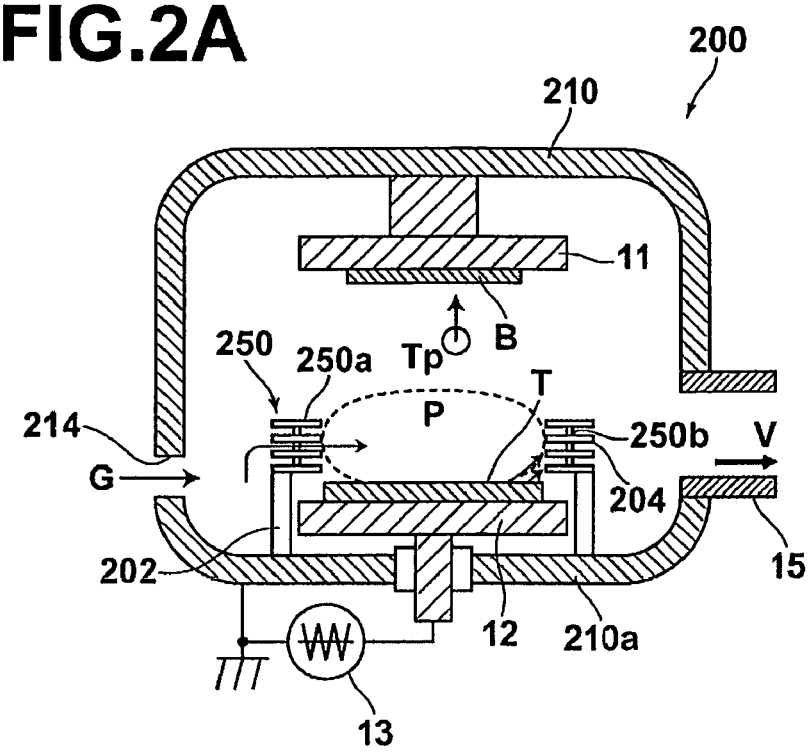
FIG. 2A is a schematic sectional view of a film formation apparatus.
Figure 2B:
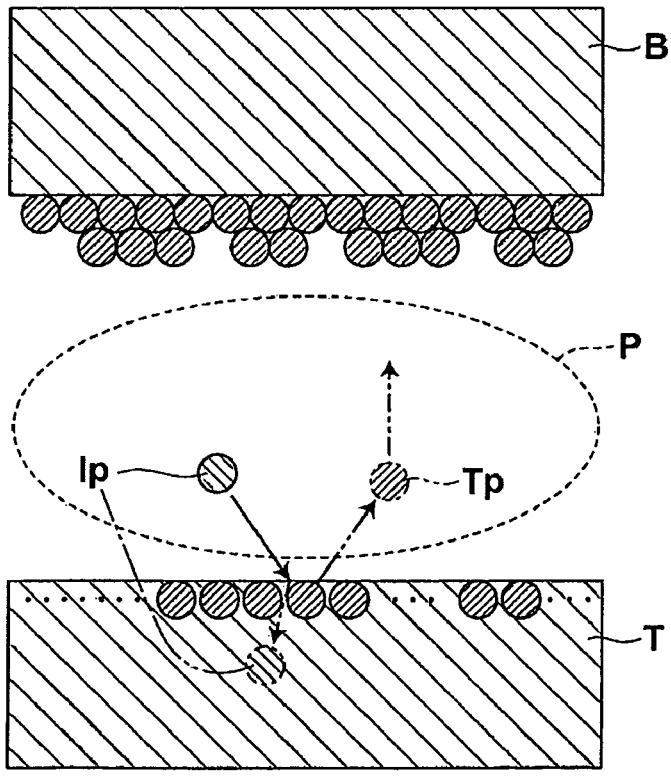
FIG. 2B is a diagram schematically illustrating how a film is formed.
Figure 3:
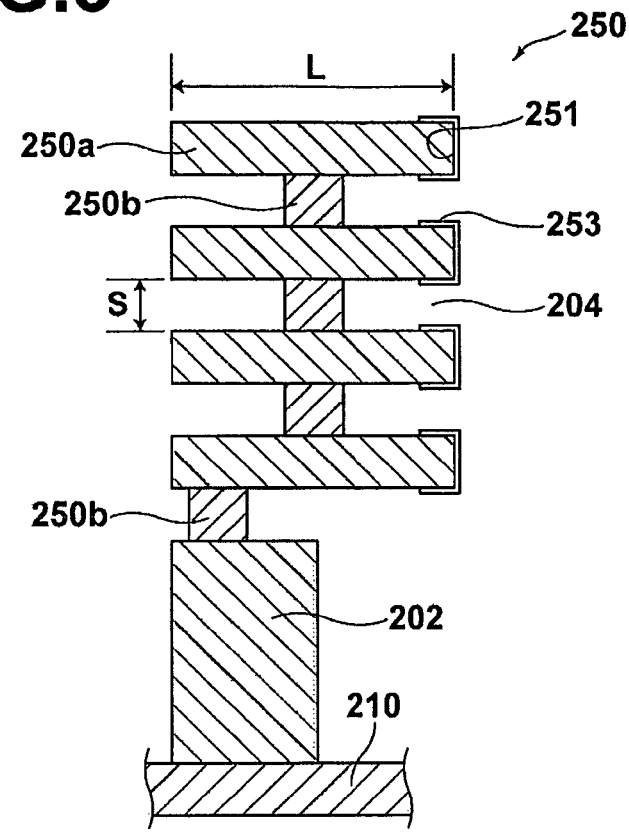
FIG. 3 is an enlarged view illustrating a shield and parts in the vicinity of the shield shown in FIG. 2A.

Now, an example of the structure of a film formation apparatus to carry out the above-described film formation method is described with reference to FIGS. 2A and 2B. In this example, a RF sputtering apparatus using a RF power supply is described by way of example. However, a DC sputtering apparatus using a DC power supply may also be used. FIG. 2A is a schematic sectional view illustrating the entire apparatus, and FIG. 2B is a diagram schematically illustrating how the film is formed. FIG. 3 is an enlarged view illustrating a shield and parts in the vicinity of the shield shown in FIG. 2A.

As shown in FIG. 2A, the film formation apparatus 200 is schematically formed by a vacuum container 210, which includes therein: a substrate holder 11, such as an electrostatic chuck, which holds a substrate (film formation substrate) B and is capable to heat the substrate B to a predetermined temperature; and a plasma electrode (cathode electrode) 12 that generates plasma. The plasma electrode 12 also serves as a target holder to hold a target T.

The substrate holder 11 and the plasma electrode 12 are spaced apart from each other and face each other. The target T having a composition according to the composition of a film to be formed is placed on the plasma electrode 12. The plasma electrode 12 is connected to a radio-frequency power supply 13. It should be noted that the plasma electrode 12 and the radio-frequency power supply 13 form a plasma generator. In this embodiment, a shield 250 is provided to surround the periphery on the film formation substrate side of the target T. In other words, the shield 250 in this embodiment surrounds the periphery on the film formation substrate side of the plasma electrode 12, or the target holder, holding the target T.

The vacuum container 210 includes: a gas inlet pipe 214 to introduce gas (film formation gas) G, which is necessary for film formation, into the vacuum container 210; and a gas outlet pipe 15 to discharge the gas (indicated by "V") from the vacuum container 210. The gas inlet port 214 to introduce the gas G is positioned on the opposite side from the gas outlet pipe 15 and at nearly the same height as the shield 250.

Examples of the gas G may include Ar or $Ar/O_2$ mixed gas. As schematically illustrated in FIG. 2B, electric discharge from the plasma electrode 12 turns the gas G introduced in the vacuum container 10 into the form of plasma, and a positive ion Ip, such as Ar ion, is produced. The produced positive ion Ip sputters the target T. A constituent element Tp of the target T sputtered by the positive ion Ip is released from the target and is deposited on the substrate B in the neutralized or ionized state. In the drawing, the symbol P indicates a plasma space.

The potential in the plasma space P is the plasma potential Vs (V) in the plasma during film formation. Usually, the substrate B is an insulator and is electrically insulated from the ground. Therefore, the substrate B is in the floating state, and the potential at the substrate B is the floating potential Vf (V). It is believed that the constituent element Tp of the target present between the target T and the substrate B hits the substrate B during film formation with a kinetic energy corresponding to an accelerating voltage, which corresponds to the potential difference Vs−Vf between the potential in the plasma space P and the potential at the substrate B.

The vacuum container 210 shown in FIG. 2A is characterized by that the shield 250, which surrounds the periphery on the film formation substrate side of the target T, is disposed in the vacuum container 210. The shield 250 is located on a ground shield, i.e., a ground member 202 standing on a bottom surface 210*a* of the vacuum container 210 to surround the plasma electrode 12, such that the shield 250 surrounds the periphery on the film formation substrate side of the target T. The ground member 202 serves to prevent the plasma electrode 12 from discharging the electricity sideward and downward in the vacuum container 210.

As one example, the shield 250 is formed by a plurality of annular metal plates, i.e., rings (fins, shield layers) 250*a*, as shown in FIGS. 2A and 3. In the example shown in the drawings, four rings 250*a* are used, and conductive spacers 250*b* are disposed between adjacent rings 250*a*. The spacers 250*b* are spaced apart from each other along the circumferential direction of the rings 250*a*, so that clearances 204 are formed between the spacers 250*b* to facilitate flow of the gas G therethrough. In this view, the spacers 250*b* may also be disposed between the ground member 202 and the ring 250*a* which is placed immediately above the ground member 202.

In the above-described structure, the shield 250 is electrically connected to the ground member 202 to be grounded. The material for forming the rings 250*a* and the spacers 250*b* is not particularly limited, and SUS (stainless steel), or the like, may be used.

A conductor member (not shown) to electrically connect the rings 250*a* to each other may be provided on the periphery of the shield 250. The rings 250*a* of the shield 250 are electrically connected to each other by the conductive spacers 250*b*, and this may be sufficient for grounding of the rings 250*a*; however, by separately providing the conductor member on the periphery of the shield 250, grounding of the rings 250*a* is facilitated.

As described above, the shield 250 is disposed to surround the periphery on the film formation substrate side of the target T, and therefore a ground potential is formed at the periphery on the film formation substrate side of the target T by the shield 250.

In this embodiment, the plasma condition can be adjusted and optimized by the shield 250 having the above-described structure to adjust and optimize the potential difference Vs−Vf (V) between the plasma potential Vs (V) and the floating potential Vf (V). The reason is believed to be as follows.

As a voltage is applied from the radio-frequency power supply 13 to the plasma electrode 12 to form the film on the substrate B, the plasma is produced above the target T, and the electric discharge is generated between the shield 250 and the target T. It is believed that this electric discharge causes the plasma to be confined in the shield 250 to decrease the plasma potential Vs, which in turn decreases the potential difference Vs−Vf (V) between the plasma potential Vs (V) and the floating potential Vf (V). As the potential difference Vs−Vf (V) between the plasma potential Vs (V) and the floating potential Vf (V) decreases, the energy of the constituent element Tp of the target T released from the target T and hitting the substrate B decreases. By optimizing the potential difference Vs−Vf (V) between the plasma potential Vs (V) and the floating potential Vf (V), the particle energy of the constituent element Tp of the target T can be optimized to allow formation of a quality film.

The potential difference Vs−Vf (V) between the plasma potential Vs (V) and the floating potential Vf (V) tends to decrease as the number of rings 250*a* forming the shield 250 is increased to increase the height of the entire shield 250. The reason of this is believed to be that increase of the height of the entire shield 250 increases the intensity of the electric discharge between the shield 250 and the target T, and this decreases the potential difference Vs−Vf (V) between the plasma potential Vs (V) and the floating potential Vf (V).

An optimal potential difference Vs−Vf (V) for film formation depends on a particular film formation temperature. In order to obtain the optimal potential difference, the number of rings 250*a* can be increased or decreased to achieve a desired potential difference without changing the film formation temperature. Since the rings 250*a* are simply stacked as the shield layers via the spacers 250*b*, the number of the rings 250*a* can be changed by removing some of the rings.

The lowermost ring 250*a* of the shield 250 is spaced apart from the periphery of the target T. If the linear distance between the target T and the shield 250 is 0, no electric discharge is generated. If the linear distance between the target T and the shield 250 is too large, the effect of the shield is reduced. Therefore, the linear distance between the target T and the shield 250 may be 1 mm to 30 mm to efficiently obtain the effect.

The constituent element Tp of the target T released from the target T is deposited on the substrate B, and is also deposited on the rings 250*a* around the target T. The areas of the rings 250*a* on which the highest amount of the constituent element Tp deposits are inner circumferential edges 251 facing the target T and areas in the vicinity of the inner circumferential edges 251 of the rings 250*a*. This state is shown in FIG. 3. As shown in FIG. 3, at the inner circumferential edges 251 of the rings 250*a* and the upper and lower surfaces of the rings 250*a* in the vicinity of the inner circumferential edges 251, films 253 are formed by the particles (deposition particles) of the constituent element Tp deposited on the rings 250*a*. If the films 253 are formed to cover the entire surfaces of the rings 250*a*, the function of the shield 250 as the ground potential is impaired. Therefore, it is preferred to form the shield 250 not to be susceptible to deposition of the films 253, as possible.

In this embodiment, the shield 250 is formed by the plurality of rings 250*a* which are stacked in the vertical direction with the clearances 204 formed therebetween. Therefore, the deposition particles of the constituent element released from the target are prevented from depositing on the entire surface of the shield 250 to alter the condition of the potential at the shield 250. Therefore, the shield 250 stably works even after repeated film formation, and the potential difference Vs−Vf between the plasma potential Vs and the floating potential Vf is stably maintained.

In particular, a thickness L of the wall material of the shield in the direction perpendicular to the stacked direction of the rings 250*a* forming the shield layers and a distance S between the adjacent rings 250*a* in the stacked direction, i.e., a distance between the shield layers, may satisfy the relationship: $L \geqq S$. The effect of keeping this relationship is that ensuring the thickness L in the predetermined range with respect to the distance S between the rings 250*a* makes the films 253 less likely to deposit on the entire surfaces of the rings 250*a*. In other words, ensuring the depth of the rings 250*a* with respect to the deposition particles makes the constituent element Tp less likely to travel through the clearances 204 to reach the periphery of the rings 250*a*, thereby preventing the shield 250 from being disabled in a short period.

The clearances 204 are expected to have another effect. Namely, it is believed that the clearances 204 serve as passages for the film formation gas G, and allow the film formation gas G to pass through the clearances 204 of the shield 250 to reach the plasma space in the vicinity of the target T. Then, the gas ion turned into the form of plasma in the vicinity of the target T can easily reach the target to effectively release the constituent element Tp from the target. As a result, a quality film having desired properties can stably be formed.

Similarly to a shield without clearances, the shield 250 having the clearances forms an equipotential wall at the inner circumference thereof. Therefore, the effect of adjusting the potential difference Vs−Vf of the shield with clearances is equivalent to that of the shield without clearances.

The film formation apparatus 200 of this embodiment is preferably applicable to formation of an insulating film, such as the piezoelectric film. The present inventors have found that the film formation conditions where the potential difference between the plasma potential Vs and the floating potential Vf is 35 eV or less and the temperature of the substrate B is 400° C. or more may allow formation of the piezoelectric film having a desired performance.

As described above, the film formation apparatus 200 of this embodiment is provided with the shield 250 which surrounds the periphery on the film formation substrate side of the plasma electrode 12, or the target holder, holding the target T and includes the clearances 204, through which the film formation gas G passes. The presence of the shield 250 enables adjustment and optimization of the condition of the potential in the plasma space. In the film formation apparatus 200 of this embodiment, the shield 250 enables control and optimization of the potential difference Vs−Vf between the plasma potential Vs and the floating potential Vf.

It is believed that, since the shield 250 of this embodiment is grounded, the shield 250 can minimize spread of the plasma, and this can decrease the potential difference Vs−Vf between the plasma potential Vs and the floating potential Vf, as a result.

Use of the film formation apparatus 200 of this embodiment enables control of the potential difference Vs−Vf between the plasma potential Vs and the floating potential Vf, thereby allowing formation of a quality film. In this embodiment, the number of the rings 250*a* can be changed to adjust the height of the shield 250 to readily control the potential difference Vs−Vf between the plasma potential Vs and the floating potential Vf.

In the film formation apparatus 200 of this embodiment, the potential difference Vs−Vf can be controlled by adjusting the height of the shield 250. Although the potential difference Vs−Vf could also be adjusted by changing the electric power applied to the target and/or the film formation pressure, if the electric power applied to the target and/or the film formation pressure are changed to control the potential difference Vs−Vf, other parameters, such as the film formation speed, are also changed, and this may result in formation of a film that dose not have a desired film quality. The present inventors conducted a experiment under certain conditions. When the electric power applied to the target was changed from 700 W to 300 W, the potential difference Vs−Vf was reduced from 38 eV to 25 eV, however, the film formation speed was also reduced from 4 μm/h to 2 μm/h. In the apparatus 200 of this embodiment, the potential difference Vs−Vf can be adjusted without changing other parameters, such as the film formation speed, and thus optimization of the film formation conditions is facilitated to allow stable formation of a quality film.

Second Embodiment of Method for Producing Piezoelectric Film

The method for producing the piezoelectric film of this embodiment uses the same film formation apparatus as that in the first embodiment, shown in FIGS. 2A and 2B, and a film formation method in which the film formation temperature Ts and the distance between the substrate B and the target T (substrate-target distance) D (mm) are optimized (see Japanese Patent Application No. 2006-263979). It should be noted that, since it is not necessary to control the potential difference Vs−Vf in this embodiment, a film formation apparatus which is not provided with the shield 250 may be used.

In the production method of this embodiment, the film is formed under the film formation conditions in which the film formation temperature Ts (° C.) and the substrate-target distance D (mm) satisfy formulae (4) and (5) or formulae (6) and (7) below:

$$400 \leqq Ts(^\circ\,\mathrm{C.}) \leqq 500 \quad (4),$$

$$30 \leqq D(\mathrm{mm}) \leqq 80 \quad (5),$$

$$500 \leqq Ts(^\circ\,\mathrm{C.}) \leqq 600 \quad (6),$$

$$30 \leqq D(\mathrm{mm}) \leqq 100 \quad (7).$$

The present inventors have found that, in the PZT piezoelectric film formed under the film formation conditions where Ts (° C.)<400, which do not satisfy formula (4), the perovskite crystal does not grow satisfactory because of the low film formation temperature, and the obtained film is mainly composed of the pyrochlore phase.

The present inventors have further found that, when the PZT piezoelectric film is formed under the condition where 400≦Ts (° C.)≦500, which satisfies formula (4), the film formation conditions determined within the range where the substrate-target distance D (mm) satisfies formula (5) allows stable growth of the perovskite crystal with low pyrochlore phase and stable minimization of the Pb loss, thereby allowing stable formation of a quality piezoelectric film with good crystal structure and film composition (see FIG. 7). When the PZT piezoelectric film is formed under the condition where 500≦Ts (° C.)≦600, which satisfies formula (6), the film formation conditions determined within the range where the substrate-target distance D (mm) satisfies formula (7) allows stable growth of the perovskite crystal with low pyrochlore phase and stable minimization of the Pb loss, thereby allowing stable formation of a quality piezoelectric film with good crystal structure and film composition (see FIG. 7).

In this embodiment, under the conditions where the film formation temperature Ts is excessively low and the substrate-target distance D is excessively large, the perovskite crystal is not likely to grow satisfactory. In contrast, under the conditions where the film formation temperature Ts is excessively high and the substrate-target distance D is excessively small, the tendency of the Pb loss increases.

That is, under the condition where 400≦Ts (° C.)≦500, which satisfies formula (4), if the film formation temperature Ts is relatively low, it is necessary to set a relatively small substrate-target distance D to satisfactory grow the perovskite crystal. In contrast, if the film formation temperature Ts is relatively high, it is necessary to set a relatively long substrate-target distance D to minimize the Pb loss. This is expressed by formula (5) above. Under the condition where 500≦Ts (° C.)≦600, which satisfies formula (6) above, the film formation temperature is relatively high, and therefore the upper limit for the substrate-target distance D is higher; however, the tendency is the same.

Figure 5:
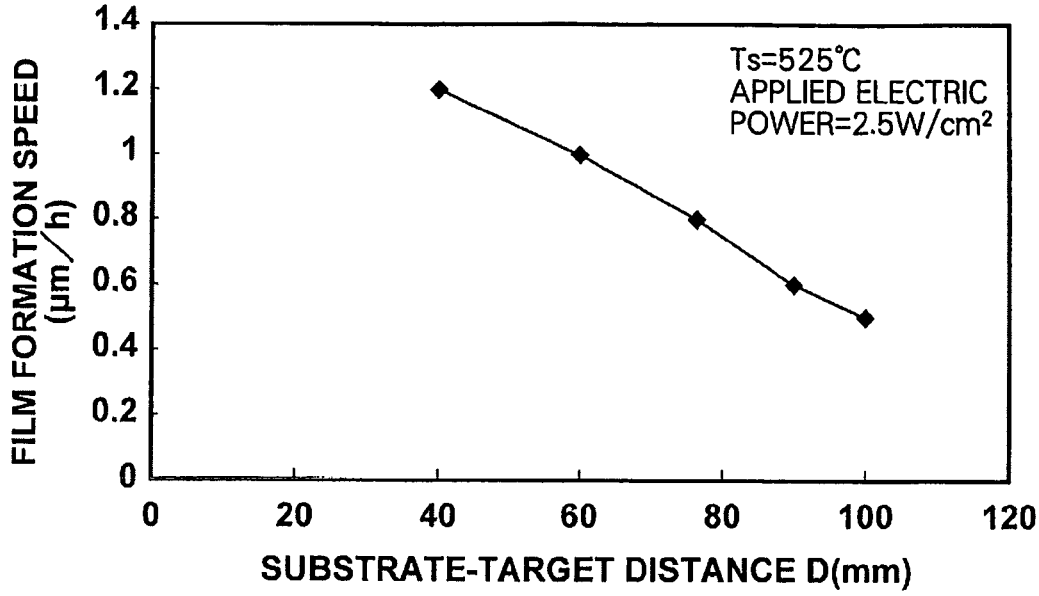
FIG. 5 is a graph showing the relationship between a substrate-target distance and a film formation speed in a production method according to a second embodiment.

In view of the efficiency of manufacture, a higher film formation speed, such as 0.5 μm/h or more, or 1.0 μm/h or more, is preferred. As shown in FIG. 5, the shorter the substrate-target distance D, the higher the film formation speed. FIG. 5 shows the relationship between the film formation speed and the substrate-target distance D when the PZT film is formed using the sputtering apparatus 1. In the example shown in FIG. 7, the film formation temperature Ts is 525° C. and the electric power applied to the target (rf power) is 2.5 W/cm$^2$. According to the invention, a quality film can be formed even under high-speed film formation conditions where the film formation speed is 1.0 μm/h or more, as shown in example 1 below.

Depending on the substrate-target distance D, the film formation speed may be less than 0.5 μm/h. In such a case, the electric power applied to the target may be adjusted to achieve the film formation speed of 0.5 μm/h or more.

A shorter substrate-target distance D is preferred to achieve a higher film formation speed In the range of 400≦Ts (° C.)≦500, the substrate-target distance D may be 80 mm or less. In the range of 500≦Ts (° C.)≦600, the substrate-target distance D may be 100 mm or less. If the substrate-target distance D is less than 30 mm, the condition of the plasma is unstable, and it may be impossible to form a quality film. In order to stably form the piezoelectric film having a higher film quality, the substrate-target distance D in the range of 50≦D (mm)≦70 may be used for either of the cases where 400≦Ts (° C.)≦500 or 500≦Ts (° C.)≦600.

The present inventors have found that, under the film formation conditions where the formulae (4) and (5) are satisfied, the film formation conditions determined to further satisfy formulae (6) and (7) allow stable formation of a quality piezoelectric film with good production efficiency, i.e., at a high film formation speed.

Third Embodiment of Method for Producing Piezoelectric Film

The method for producing the piezoelectric film of this embodiment uses the same film formation apparatus as that in the first embodiment, shown in FIGS. 2A and 2B, and a film formation method in which the film formation temperature Ts and the plasma potential Vs (V) in the plasma during film formation are optimized (see Japanese Patent Application No. 2006-263980). It should be noted that, since it is not necessary to control the potential difference Vs−Vf in this embodiment, a film formation apparatus without the shield 250 may be used.

In the production method of this embodiment, the film is formed under the film formation conditions where the film formation temperature Ts (° C.) and the plasma potential Vs (V) in the plasma during film formation satisfy formulae (8) and (9) or formulae (10) and (11) below:

$$400 \leqq Ts(^\circ\,C.) \leqq 475 \quad (8),$$

$$20 \leqq Vs(V) \leqq 50 \quad (9),$$

$$475 \leqq Ts(^\circ\,C.) \leqq 600 \quad (10),$$

$$Vs(V) \leqq 40 \quad (11).$$

In this embodiment, the plasma potential Vs can be changed, for example, by providing a ground between the substrate and the target. Further, similarly to the potential difference Vs−Vf, the plasma potential Vs is considered to have the same effect on the substrate B as that of the temperature, the effect of promoting the surface migration, the effect of etching weakly bound portions, and the like.

The present inventors have found that, when the piezoelectric film composed of the perovskite oxide represented by general formula (P-1) or (P-2) is formed under the condition where 400≦Ts (° C.)≦475, which satisfies formula (8), the film formation conditions determined within the range where the film formation temperature Ts and the plasma potential Vs satisfy formula (9) allow stable growth of the perovskite crystal with low pyrochlore phase and stable minimization of the Pb loss. Under the condition where 475≦Ts (° C.)≦600, which satisfies formula (10), the film formation conditions determined within the range where the film formation temperature Ts and the plasma potential Vs satisfy formula (11) allow stable growth of the perovskite crystal with low pyrochlore phase and stable minimization of the Pb loss.

The present inventors have further found that, in order to stably form a piezoelectric film having better crystal structure and film composition, the film formation conditions determined to satisfy formulae (12) and (13) below may be used, or optionally the film formation conditions determined to satisfy formulae (14) and (15) or formulae (16) and (17) below may be used (see FIG. 8).

$$420 \leqq Ts(^\circ\,C.) \leqq 575 \quad (12),$$

$$-0.15Ts+111 < Vs(V) < -0.2Ts+114 \quad (13),$$

$$420 \leqq Ts(^\circ\,C.) \leqq 460 \quad (14),$$

$$30 \leqq Vs(V) \leqq 48 \quad (15),$$

$$475 \leqq Ts(^\circ\,C.) \leqq 575 \quad (16),$$

$$10 \leqq Vs(V) \leqq 38 \quad (17).$$

As can be seen from FIG. 8, under the conditions where the film formation temperature Ts and the plasma potential Vs are excessively low, the perovskite crystal is not likely to grow satisfactory. In contrast, under the conditions where at least one of the film formation temperature Ts and the plasma potential Vs is excessively high, the tendency of the Pb loss increases.

In this embodiment, the substrate-target distance is not particularly limited, however, may be in the range from 30 to 80 mm. In view of the efficiency, a smaller substrate-target distance provides a higher film formation speed. However, if the distance is too small, the plasma discharge is unstable and it is difficult to form a quality film.

The present inventors have found that, when the piezoelectric film composed of the perovskite oxide represented by general formula (P-1) or (P-2) is formed, the film formation conditions determined to satisfy formulae (8) and (18) or formulae (10) and (19) below allow formation of the piezoelectric film having a high piezoelectric constant.

$$400 \leqq Ts(^\circ\,\mathrm{C.}) \leqq 475 \quad (8),$$

$$35 \leqq Vs(V) \leqq 45 \quad (18),$$

$$475 \leqq Ts(^\circ\,\mathrm{C.}) \leqq 600 \quad (10),$$

$$10 \leqq Vs(V) \leqq 35 \quad (19).$$

The present inventors have found that, when the piezoelectric film composed of the perovskite oxide represented by general formula (P-1) or (P-2) is formed using any of the production methods according to the first to third embodiments described above, films formed under the conditions in the range indicated by the "circle" marks in FIGS. 6, 7, and 8 exhibit a piezoelectric constant $d_{31} \geqq 200$ pm/V. On the other hand, films formed under the conditions in the ranges indicated by the "triangle" and "cross" marks exhibit a piezoelectric constant $d_{31} < 200$ pm/V.

EXAMPLES

Now, examples of the piezoelectric film suitable for use in the piezoelectric device in the head are described.

In each example, the head was prepared by machining a Si substrate through MEMS (Micro Electro Mechanical Systems) machining. The film thickness of the piezoelectric film was 4 μm, and the thickness of the Si diaphragm was 10 μm. The amount of displacement was measured by applying to the piezoelectric film a square wave of −30 V at 1 kHz. The head was heated with a hot plate placed on the back side of the head. The temperature at this time was measured with a thermocouple attached on the Si surface. The displacement of the head was measured with a laser Doppler meter.

Example 1

A Nb-PZT ($Pb_{1.1}Zr_{0.43}Ti_{0.44}Nb_{0.13}O_3$) film having a columnar structure was formed according to the first film formation method using the film formation apparatus shown in FIG. 2A. The film formation temperature was 450° C.

Figure 9:
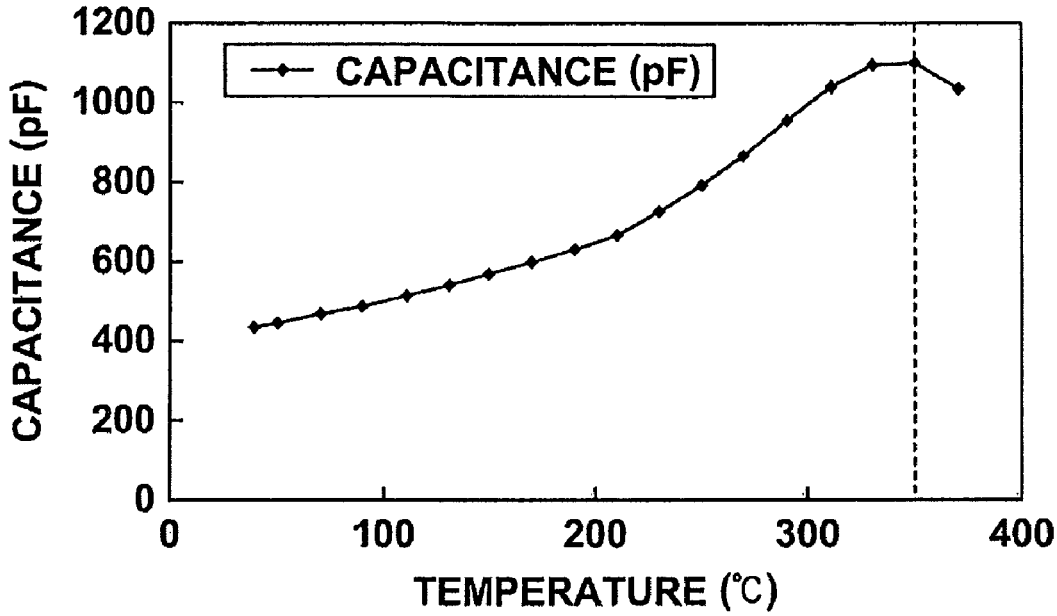
FIG. 9 is a graph showing variation of capacitance with temperature for a piezoelectric film of example 1.
Figure 10:
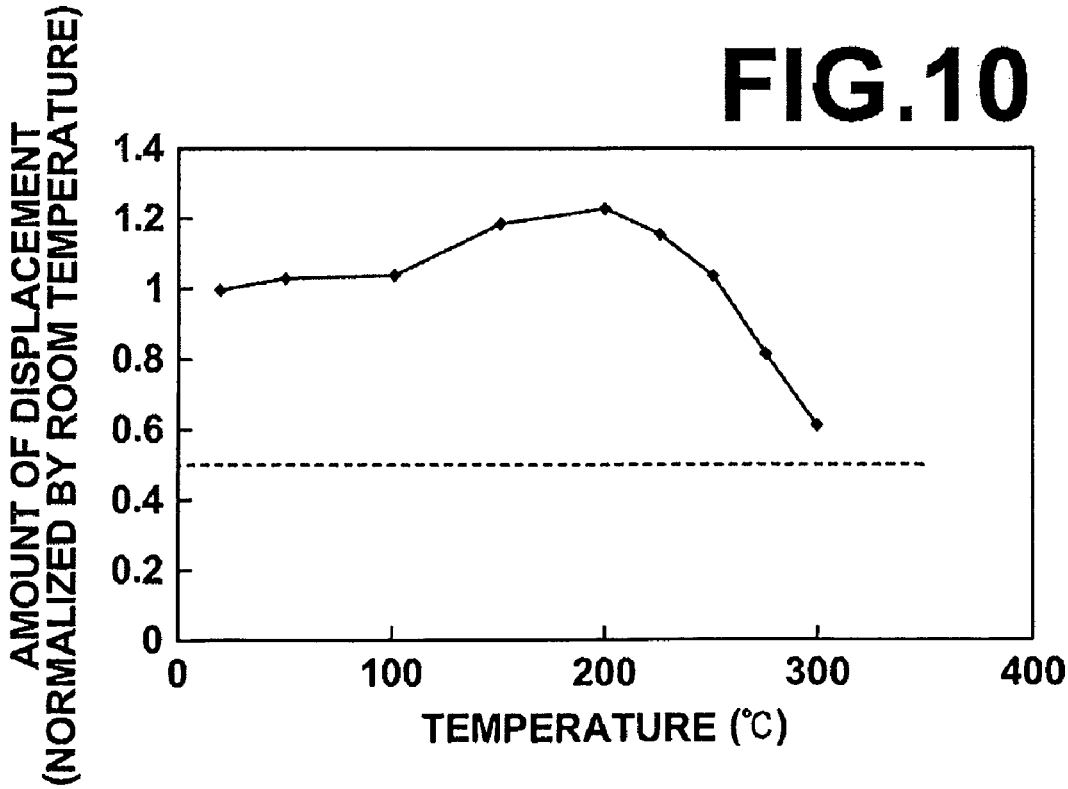
FIG. 10 is a graph showing variation of amount of displacement with temperature for the piezoelectric film of example 1.

Results of measurement of physical properties of the Nb-PZT film formed under the above conditions are shown in FIGS. 9 and 10. FIG. 9 shows variation of the capacitance with temperature of the piezoelectric film, which were examined with heating the piezoelectric film to find the Curie point of the piezoelectric film. The Curie point of the piezoelectric film was about 350° C. FIG. 10 shows variation of the amount of displacement with temperature of the piezoelectric film, normalized by the amount of displacement at the room temperature, when a predetermined voltage was applied to the piezoelectric film. In the range up to about 300° C., the amount of displacement of the piezoelectric film keeps 60% or more of the displacement at the room temperature (25° C.), and a sufficient displacement was provided at the high temperature of 300° C. Thus, the Nb-PZT film of example 1 was found to be effective as the piezoelectric device.

A piezoelectric constant $d_{31}$ at the room temperature of the Nb-PZT film, which was calculated using the ANSYS from the above data, was 250 pm/V. The direction of the spontaneous polarization of the film was such that the side of the film facing the lower electrode layer was the positive side and the side of the film facing the upper electrode layer was the negative side.

The head including the Nb-PZT film having the above-described physical properties was heated to 270° C., and a Sn—Ag solder material was charged from the reservoir into the pressurized liquid chamber. Then, the head was driven while a predetermined pressure was applied by the pump, and the melt solder material was ejected from the nozzle.

Example 2

A Bi-PZT ($Pb_{0.9}Bi_{0.10}Zr_{0.52}Ti_{0.48}O_3$) film having a columnar structure was formed according to the first film formation method using the film formation apparatus shown in FIG. 2A. The film formation temperature was 450° C.

Physical properties of the Bi-PZT film formed under the above conditions were measured, and the Curie point of the film was about 220° C. The amount of displacement of the film at 170° C. was about 60% of the amount of displacement of the film at the room temperature. The piezoelectric constant at the room temperature of this film, which was calculated using the ANSYS, was 200 pm/V. From these points, this film was found to sufficiently work as the piezoelectric material at the temperature of 170° C.

In the liquid ejection device of the invention, the piezoelectric film of the piezoelectric device is formed by a thin-film piezoelectric material having a Curie point of 200° C. or more. Therefore, a material having a melting point of 150° C. or more and lower than the Curie point of the piezoelectric film can be ejected in the liquid phase by charging the material in the pressurized liquid chamber and heating the material to a temperature not lower than the melting point of the material. Since typical solder materials have a melting point ranging from about 180 to 250° C., the liquid ejection device of the invention, which includes the piezoelectric film having a Curie point higher than the melting point of a desired solder material, can eject the solder material in the melted state through the liquid ejection orifice. This allows electronic parts to be mounted on a wiring board through soldering without need of the conventionally-required heat treatment (reflow treatment).

What is claimed is:

1. A liquid ejection device comprising:

a liquid ejection member comprising a pressurized liquid chamber and a liquid ejection orifice, the liquid ejection orifice being in fluid communication with the pressurized liquid chamber to eject a liquid in the pressurized liquid chamber to the outside;

a vibrating diaphragm;

a piezoelectric device formed on the pressurized liquid chamber via the vibrating diaphragm, the piezoelectric device comprising a lower electrode, a piezoelectric film and an upper electrode disposed sequentially, the piezoelectric film being a thin-film piezoelectric material having a Curie point of 200° C. or more; and heating means for heating a material charged in the pressurized liquid chamber, the material having a melting point of not less than 150° C. and lower than the Curie point of the piezoelectric film, the heating means heating the material to a temperature not less than the melting point of the material.

2. The liquid ejection device as claimed in claim 1, wherein the material is a low melting point metal.

3. The liquid ejection device as claimed in claim 1, wherein the material is a solder material.

4. The liquid ejection device as claimed in claim 1, wherein an amount of displacement of the piezoelectric film at an operating temperature, when a predetermined driving voltage is applied to the piezoelectric film, is at least 50% of an amount of displacement of the piezoelectric film at a room temperature.

5. The liquid ejection device as claimed in claim 1, wherein a piezoelectric constant of the piezoelectric film at a room temperature is at least 200 pm/V.

6. The liquid ejection device as claimed in claim 1, wherein the piezoelectric film comprises a perovskite oxide.

7. The liquid ejection device as claimed in claim 6, wherein the piezoelectric film has a columnar crystalline film structure comprising a number of columnar crystals.

8. The liquid ejection device as claimed in claim 6, wherein the piezoelectric film has (100) crystal orientation.

9. The liquid ejection device as claimed in claim 6, wherein a composition of the piezoelectric film comprises lead zirconate titanate and at least one selected from the group consisting of Nb, W, Ni and Bi added thereto.

10. The liquid ejection device as claimed in claim 1, wherein the pressurized liquid chamber is formed in a Si substrate.

11. The liquid ejection device as claimed in claim 1, wherein the heating means is disposed outside the liquid ejection member and heats the material via the liquid ejection member.

12. The liquid ejection device as claimed in claim 11, wherein the heating means comprises a thin-film heating element.

13. The liquid ejection device as claimed in claim 1, wherein the piezoelectric film polarizes in a direction from the lower electrode side to the upper electrode side, a positive side of the spontaneous polarization of the piezoelectric film faces the lower electrode layer, and a negative side of the spontaneous polarization of the piezoelectric film faces the upper electrode layer, and the upper electrode layer is a ground electrode where an applied voltage is fixed, and the lower electrode layer is an address electrode where an applied voltage is varied.

14. A liquid ejection device comprising:

a liquid ejection member comprising a pressurized liquid chamber and a liquid ejection orifice, the liquid ejection orifice being in fluid communication with the pressurized liquid chamber to eject a liquid in the pressurized liquid chamber to the outside;

a vibrating diaphragm;

a piezoelectric device formed on the pressurized liquid chamber via the vibrating diaphragm, the piezoelectric device comprising a lower electrode, a piezoelectric film and an upper electrode disposed sequentially, the piezoelectric film being a thin-film piezoelectric material having a Curie point of 200° C. or more; and heating device for heating a material charged in the pressurized liquid chamber, the material having a melting point of not less than 150° C. and lower than the Curie point of the piezoelectric film, the heating device heating the material to a temperature not less than the melting point of the material.

15. The liquid ejection device as claimed in claim 14, wherein the material is a low melting point metal.

16. The liquid ejection device as claimed in claim 14, wherein the material is a solder material.

17. The liquid ejection device as claimed in claim 14, wherein an amount of displacement of the piezoelectric film at an operating temperature, when a predetermined driving voltage is applied to the piezoelectric film, is at least 50% of an amount of displacement of the piezoelectric film at a room temperature.

18. The liquid ejection device as claimed in claim 14, wherein a piezoelectric constant of the piezoelectric film at a room temperature is at least 200 pm/V.

19. The liquid ejection device as claimed in claim 14, wherein the piezoelectric film comprises a perovskite oxide.

20. The liquid ejection device as claimed in claim 19, wherein the piezoelectric film has a columnar crystalline film structure comprising a number of columnar crystals.

* * * * *